US009422128B2

(12) United States Patent
Kaiga

(10) Patent No.: US 9,422,128 B2
(45) Date of Patent: Aug. 23, 2016

(54) SHEET CONVEYING APPARATUS AND IMAGE FORMING APPARATUS

(71) Applicant: CANON KABUSHIKI KAISHA, Tokyo (JP)

(72) Inventor: Miho Kaiga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/676,003

(22) Filed: Apr. 1, 2015

(65) Prior Publication Data

US 2015/0284198 A1 Oct. 8, 2015

(30) Foreign Application Priority Data

Apr. 3, 2014 (JP) ..... 2014-076748

(51) Int. Cl.

| | |
|---|---|
| ***B65H 7/02*** | (2006.01) |
| ***B65H 5/06*** | (2006.01) |
| ***B65H 5/38*** | (2006.01) |
| ***B65H 7/14*** | (2006.01) |
| ***B65H 9/00*** | (2006.01) |

(52) U.S. Cl.

CPC ..... *B65H 7/02* (2013.01); *B65H 5/062* (2013.01); *B65H 5/38* (2013.01); *B65H 7/14* (2013.01); *B65H 9/006* (2013.01); *B65H 2404/6111* (2013.01); *B65H 2553/412* (2013.01); *B65H 2553/512* (2013.01); *B65H 2553/82* (2013.01)

(58) Field of Classification Search

CPC ..... B65H 5/068; B65H 7/20; B65H 9/002; B65H 7/06; B65H 7/18

USPC ..... 271/258.01, 258.02, 265.01, 265.02, 271/272–274, 314, 259, 227

See application file for complete search history.

(56) References Cited

U.S. PATENT DOCUMENTS

| | | | | |
|---|---|---|---|---|
| 6,409,043 | B1 * | 6/2002 | Fujita et al. | 271/10.03 |
| 6,564,966 | B2 | 5/2003 | Kaiga et al. | |
| 7,593,683 | B2 * | 9/2009 | Kim et al. | 399/388 |
| 8,540,239 | B2 | 9/2013 | Kaiga et al. | |
| 2012/0099875 | A1 * | 4/2012 | Yagi et al. | 399/16 |

FOREIGN PATENT DOCUMENTS

JP 09183539 A 7/1997

OTHER PUBLICATIONS

Copending unpublished U.S. Appl. No. 14/677,001 to Miho Kaiga, filed Apr. 2, 2015.

Copending unpublished U.S. Appl. No. 14/677,016 to Taku Nishikawa et al., filed Apr. 2, 2015.

* cited by examiner

*Primary Examiner* — Thomas Morrison

(74) *Attorney, Agent, or Firm* — Fitzpatrick, Cella, Harper & Scinto

(57) ABSTRACT

A sheet conveying apparatus includes first and second rotator pairs and a sheet detecting portion. The sheet detecting portion includes a moving member provided to move to a detection state from a standby state in which the moving member protrudes into a sheet conveying path by being pressed by a front end of the sheet conveyed by the first rotator pair and such that a rear end of the sheet does not pass within a moving trajectory of the moving member in moving from the detection state to the standby state and a sensor detecting the sheet based on the move of the moving member from the standby state to the detection state.

15 Claims, 12 Drawing Sheets

SHEET CONVEYING APPARATUS AND IMAGE FORMING APPARATUS

BACKGROUND OF THE INVENTION

1. Field of the Invention

The present invention relates to a sheet conveying apparatus conveying a sheet and an image forming apparatus.

2. Description of the Related Art

Hitherto, an image forming apparatus such as a copier, a printer, and a facsimile includes a sheet conveying apparatus configured to convey a sheet.

The sheet is conveyed to an image forming portion by the sheet conveying apparatus, and a toner image formed on a photoconductive drum is transferred onto the sheet. The sheet on which the toner image has been transferred is conveyed to a fixing portion and is then conveyed to a discharging portion.

In conveying a sheet in the conventional sheet conveying apparatus, switching operations of various switching units and a switching operation for switching a direction of rotation of a sheet conveying portion are performed based on detection of a front end of the sheet. Then, in order to detect the front end of the sheet as described above, the sheet conveying apparatus is provided with a sheet detection portion configured to detect passage of the sheet on a sheet conveying path.

Examples of such conventional sheet detection portion include one including a sensor flag (moving member) against which a front end of the sheet abuts and is turned and a detection sensor detecting the turned sensor flag and inputting a detection signal to a control portion as disclosed in JP-A-9-183539. In the sheet detection portion, when the sensor flag pressed by the sheet turns from a standby position to a detection position where the detection sensor can detect the flag, the detection sensor detecting the turn of the flag inputs a detection signal to the control portion.

In response to the input of the detection signal, the control portion determines that the sheet being conveyed has reached the sheet conveyance path. Subsequently, when the sheet has passed through the sensor flag, the pressure of the sheet is released, and hence the sensor flag is returned back to the original standby position from the detection position, no more detection signal is inputted from the detection sensor. If no more detection signal is inputted, the control portion determines that the sheet has passed through the sheet conveyance path.

By the way, lately, the image forming apparatus is required to improve productivity further, i.e., to increase a number of image forming sheets per unit time. To that end, a sheet conveying speed is increased, and a distance from a rear end of a sheet being conveyed to a front end of a successively conveyed next sheet (referred to as an 'inter-sheet distance' hereinafter) is shortened.

Then, in the sheet detecting apparatus, in order to shorten the inter-sheet distance, it is necessary to return the sensor flag back to the standby position from the detection position within a short time after the preceding sheet has passed.

Here, in order for the sheet detection portion to detect the front end of the succeeding sheet, a distance between the rear end of the sheet and the front end of the succeeding sheet, i.e., the inter-sheet distance of $\Delta t \cdot V$ is required: where $\Delta t$ is a time required for the sensor flag to return to the standby position from the detection position, and V is a sheet conveying speed. Therefore, if the sheet conveying speed is fast, the inter-sheet distance needs to be increased. That is, if the sheet conveying speed is increased, the inter-space distance cannot be shortened.

SUMMARY OF THE INVENTION

According to an aspect of the present invention, a sheet conveying apparatus including a first rotator pair conveying a sheet, a second rotator pair provided at downstream, in a sheet conveying direction, of the first rotator pair, and a sheet detecting portion detecting the sheet being conveyed in a sheet conveying path between the first and second rotator pairs. The sheet detecting portion includes a moving member provided to move to a detection state from a standby state in which the moving member protrudes into the sheet conveying path by being pressed by a front end of the sheet conveyed by the first rotator pair and configured such that a rear end of the sheet does not pass within a moving trajectory of the moving member in moving from the detection state to the standby state, and a sensor detecting the sheet based on the move of the moving member from the standby state to the detection state.

Further features of the present invention will become apparent from the following description of exemplary embodiments with reference to the attached drawings.

DESCRIPTION OF THE EMBODIMENTS

Figure 1:
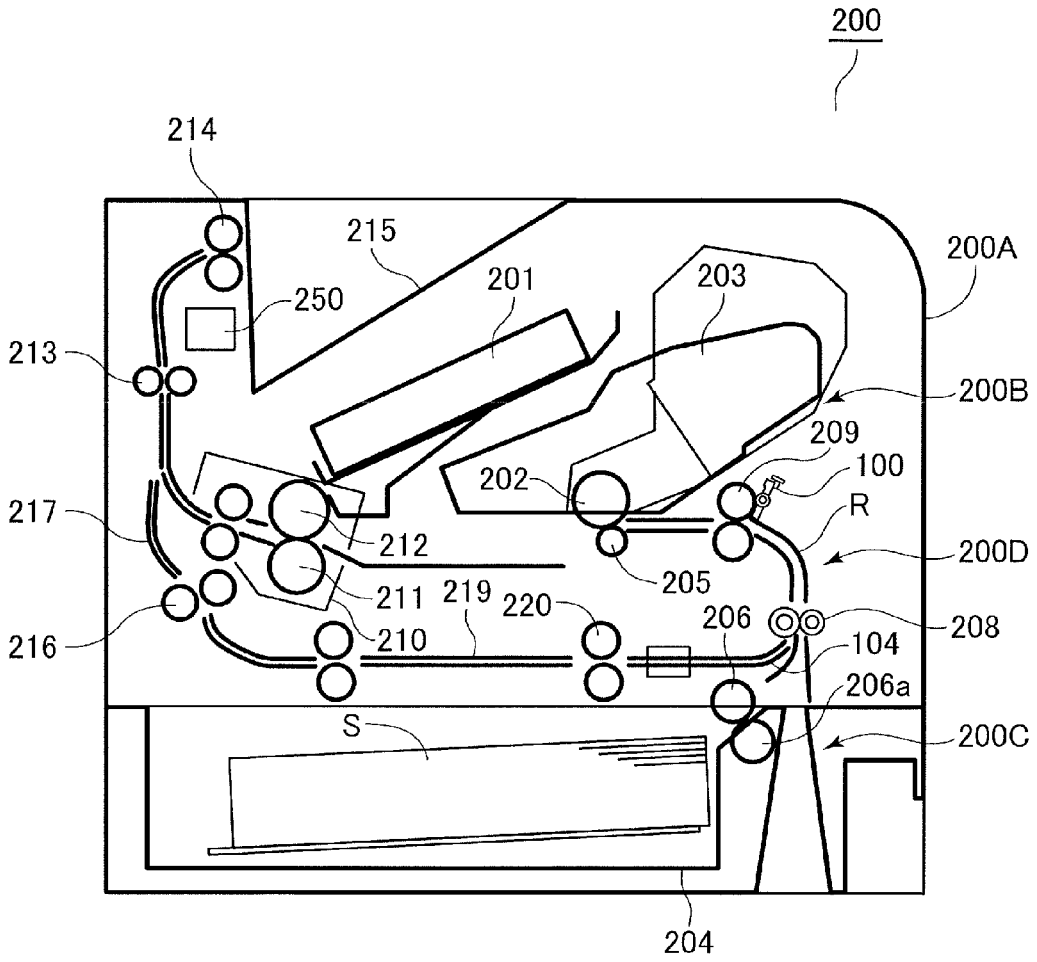
FIG. 1 is a schematic diagram illustrating a configuration of a laser printer as one example of an image forming apparatus provided with a sheet conveying apparatus of a first embodiment of the present invention.

Modes for implementing the present invention will be described with reference to the drawings. FIG. 1 is a diagram illustrating a schematic configuration of a laser printer as one example of an image forming apparatus provided with a sheet conveying apparatus of a first embodiment of the present invention. In FIG. 1, the laser printer includes, a laser printer body (referred to as an 'apparatus body' hereinafter) 200A and an image forming portion 200B provided in the apparatus body 200A. The laser printer 200 further includes a sheet feeding apparatus 200C provided in a lower part of the apparatus body 200A and a sheet conveying apparatus 200D conveying a sheet fed from the sheet feeding apparatus 200C to the image forming portion 200B.

The image forming portion 200B includes a cartridge unit 203 having a photoconductive drum 202, i.e., an image carrier, and a laser scanner 201 configured to expose the photoconductive drum 202. In forming an image, the photoconductive drum 202 is exposed by the laser scanner 201 to forma latent image on a surface of the photoconductive drum 202 and, subsequently, a toner image is formed on the surface of the photoconductive drum 202 by developing the latent image.

The sheet feeding apparatus 200C includes a sheet feeding cassette 204, i.e., a sheet stacking portion, provided drawably within the apparatus body 200A, and a sheet feed roller 206 provided above the sheet feeding cassette 204 and delivering a sheet S stored in the sheet feeding cassette 204. The sheet feeding apparatus 200C comes into pressure contact with the sheet feed roller 206, and is provided with a separating roller 206*a* constituting a separating unit separating the sheet S delivered from the sheet feed roller 206.

The sheet feeding apparatus 200C configured as described above feeds the sheet S stored in the sheet feeding cassette 204 by the sheet feed roller 206 in parallel with a toner image forming operation of the image forming portion 200B described above. Then, the sheets are separated one by one by the separating roller 206*a*. The separated sheet S is conveyed to a registration roller pair 209 by a conveying roller pair (first rotator pair) 208 of the sheet conveying apparatus 200D provided along a sheet conveyance path R. Then, a skew of the sheet S is corrected by the registration roller pair (second rotator pair) 209 and is conveyed to a transfer portion formed by the photoconductive drum 202 and a transfer roller 205 at a predetermined timing.

At the transfer portion, the toner image formed on the surface of the photoconductive drum is transferred to the sheet S conveyed to the transfer portion, and subsequently, the sheet S is fed to a fixing portion 210 including a drive roller 211 and a fixing roller 212 provided with a heater integrated therein. The toner image is heated and pressurized in passing through the drive and fixing rollers 211 and 212, and hence fixed onto the sheet S. The sheet S after the fixation is discharged onto a discharge tray 215 out of the apparatus by an inner discharge roller pair 213 and an outer discharge roller 214.

Meanwhile, in a case of forming an image also on a second surface, the sheet having the image formed on one surface passes through the fixing portion 210, and then is subjected to a switch-back conveyance by a reverse rotation of the inner and outer discharge roller pairs 213 and 214. The sheet S is then conveyed again to the transfer portion by conveying rollers 216 and 220 provided along a reverse conveying path 219 and the registration roller pair 209. At the transfer portion, an image is formed on the opposite surface, and then the sheet is discharged onto the discharge tray 215.

As illustrated in FIG. 1, the apparatus body 200A is provided, at a predetermined position thereof, with a control portion 250 controlling the image forming operation of the image forming portion 200B and a sheet conveying operation of the sheet conveying apparatus 200D. The sheet conveying apparatus 200D is provided with a sheet detecting apparatus 100 detecting a passage of the sheet at an upstream in a sheet conveying direction of the registration roller pair 209 for example. The sheet detecting apparatus 100 inputs a detection signal to the control portion 250, and in response to the input of the detection signal from the sheet detecting apparatus 100, the control portion 250 detects the passage of the sheet.

Figure 2:
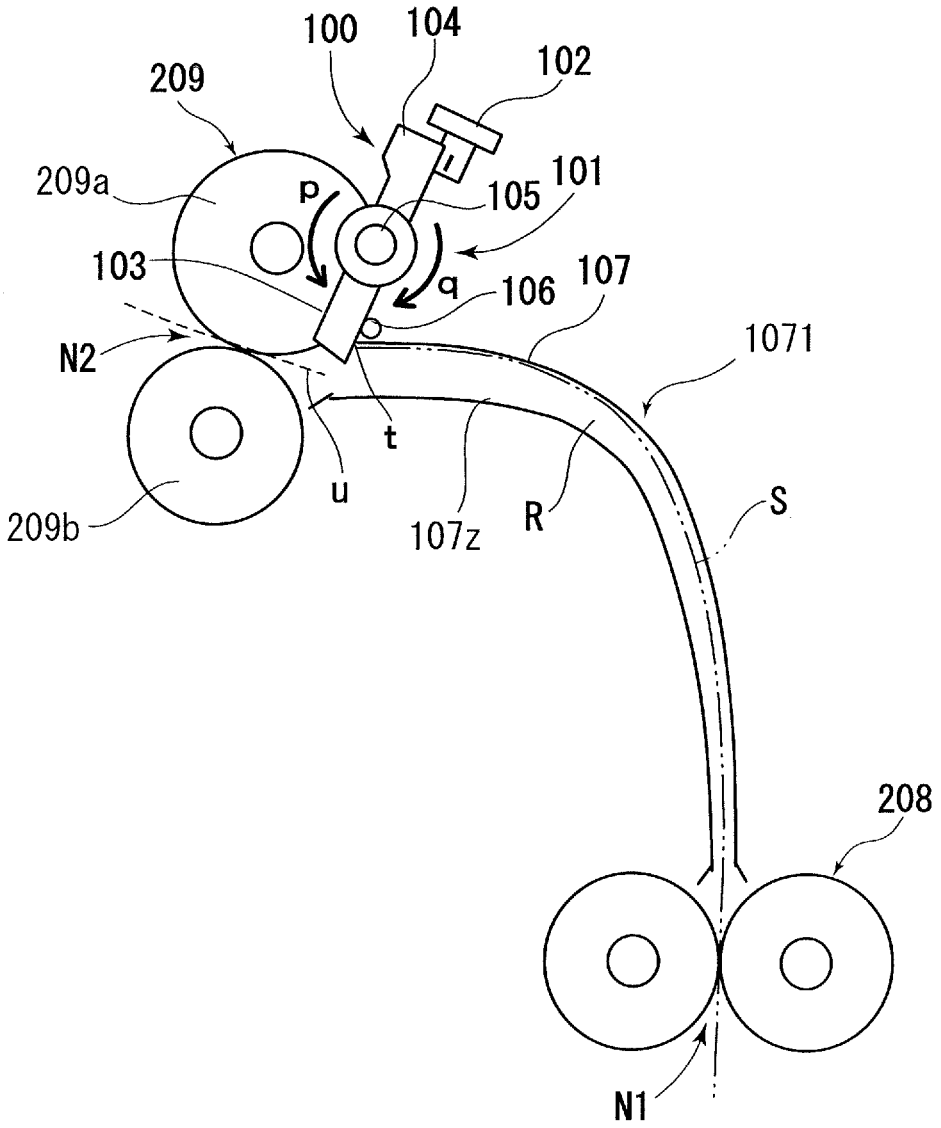
FIG. 2 is a side view illustrating a sheet detecting apparatus provided in the sheet conveying apparatus.

The sheet detecting apparatus 100 includes a lever member 101, i.e., a moving member, which is turned by the sheet abutting against the lever member and an optical sensor 102 as illustrated in FIG. 2. The lever member 101 is configured to be turnable (swingable) about a turnable shaft 105, and includes a sheet abutting portion 103 against which the sheet abuts, and a light-shielding flag portion 104 blocking an optical path from a light-emitting portion to a light receiving portion of the optical sensor 102.

The lever member 101 is biased in a direction indicated by an arrow p by a bias spring not illustrated, i.e., a bias portion, mounted on the turnable shaft 105, and the sheet abutting portion 103 is positioned at a detection standby position in which the sheet abutting portion 103 enters the sheet conveyance path R by a stopper 106 provided on the apparatus body 200A. If a front end of the sheet S being conveyed comes into abutment with the sheet abutting portion 103 located at the detection standby position, the lever member 101 turns in a direction indicated by an arrow q about the turnable shaft 105 against the bias spring, and the light-shielding flag portion 104 blocks the optical path of the optical sensor 102. It is noted that the lever member 101 is arranged such that a predetermined gap exists between the lever member 101 and a counter conveyance guide (second conveyance guide) 107*z* at the standby position.

Thereby, a signal indicating that the optical path is blocked, i.e., a detection signal indicating that an arrival of the sheet S is detected, is inputted from the optical sensor 102 of the sheet detecting apparatus 100 to the control portion 250. The position of the lever member 101 when the optical path is blocked by the light-shielding flag portion 104 in this manner will be referred to as a 'detection position' hereinafter. It is noted that when the sheet S is subsequently conveyed and a rear end of the sheet S passes through the lever member 101, the pressure applied by the sheet S is released, the lever member 101 turns in the direction indicated by the arrow p by the bias spring, and the optical path is brought into a light-transmitting state. Thereby, no more detection signal is inputted from the optical sensor 102, and the control portion 250 determines that the sheet has passed through. In this manner, the lever member 101 reciprocates between the detection standby position and the detection position in association with the passage of the sheet S.

Thus, the lever member 101 becomes a sensor flag of the optical sensor 102 and reciprocates between the detection standby position where the lever member 101 protrudes into the sheet conveying path R at upstream in the sheet conveying direction of the nip portion N2 of the registration roller pair 209 and the detection position where the lever member 101 turns centering on the rotary shaft 105 by being pressed by the sheet conveyed by the conveying roller pair 208 in association with the passage of the sheet S. That is, by being put into the detection standby position, the lever member 101 is put into the standby state in which the lever member 101 protrudes into the sheet conveying path R by being pressed by the front end of the sheet conveyed by the conveying roller pair 208 and abuts against the sheet. Then, the lever member 101 is put into the standby state by being moved from the detection standby position to the detection state by being pressed by the sheet conveyed by the conveying roller pair 208. The optical sensor 102 also detects the sheet based on the move from the standby state to the detection state of the lever member 101.

It is noted that while the moving member transmitting the arrival of the sheet to the sensor is constructed solely by the lever member 101 in the pm, the moving member may be constructed by a combination of a plurality of lever members (turning member) or may be constructed by a rotator having a plurality of protrusions around an outer periphery thereof. Still further, as illustrated in FIG. 2, a conveyance guide 107 composing apart of the sheet conveying path R is provided between the registration roller pair 209, i.e., the first rotator pair, and the registration roller pair 209, i.e., the second rotator pair. The conveyance guide 107 is a first conveyance guide guiding the sheet to a side of the lever member (moving member) 101 of the sheet conveying path R. the counter conveyance guide (second conveyance guide) 107*z* is also provided so as to face the first conveyance guide. Then, a guide portion 1071 composing the sheet conveying path R between the conveying roller pair 208 and the registration roller pair 209 is constructed by the conveyance guide 107 and the counter guide 107*z*.

Here, as illustrated in FIG. 2, a direction of a nip line indicating a sheet conveying direction of a nip portion N1 of the conveying roller pair 208 is different from a direction of a nip line indicating a sheet conveying direction of the nip portion N2 of the registration roller pair 209. The conveyance guide 107 is curved so as to guide the sheet S conveyed by the conveying roller pair 208 to the registration roller pair 209 whose nip line directions are different from each other. That is, the registration roller pair 209 includes a first rotator 209*a* provided on a side same with the lever member 101 with respect to the nip portion N2 (nip line) and a second rotator 209*b* provided so as to face the first rotator 209*a*. Then, the guide portion 1071, i.e., the sheet conveying path R between the conveying roller pair 208 and the registration roller pair 209, is constructed curvedly such that a curvature of the first rotator 209*a* side is larger than the second rotator 209*b* side. It is noted that the nip line refers to a straight line orthogonal to a straight line connecting centers of rotation of the first and second rollers of the rotator pair and is a tangential line of the roller at the nip portion.

Here, in the present embodiment, the lever member 101 is arranged such that the sheet abutting portion 103 protrudes from the conveyance guide side (the guide portion side) into the sheet conveyance path and is positioned above the nip line of the registration roller pair 209. An end of the lever member 101 protruding into the sheet conveyance path is apart from the opposed conveyance guide 107*z* in a direction of thickness of the sheet. By arranging the lever member 101 at the position as described above, the sheet S conveyed while being guided by the conveyance guide 107 comes into abutment with the sheet abutting portion 103 at a position indicated by reference sign t.

The position t where the front end of the sheet S conveyed by being guided by the conveyance guide 107 comes into abutment with the sheet abutting portion 103 as described above will be referred to as a 'front end passing position t' hereinafter. When the sheet S conveyed by the conveying roller pair 208 as described later is handed to the registration roller pair 209, the sheet S passes through a conveyance passage route u, which extends on the nip line of the registration roller pair 209.

In other words, after when the sheet S is conveyed while being guided by the conveyance guide 107 and reaches the front end passing position t, the sheet S passes through the registration roller pair 209 by passing through the conveyance passage route u, which is a route different from one until then. Here, according to the present embodiment, the sheet conveying direction in passing through the conveyance passage route u is set such that an obtuse angle is formed with respect to a guide direction of the conveyance guide 107 going in a positive direction (counterclockwise). More specifically, The registration roller pair 209 is arranged such that as the nip line which is the tangential line of the nip portion N2 advances from the upstream side to the downstream side in the sheet conveying direction, the nip line is inclined in a direction approaching from the second rotator 209*b* to the first rotator 209*a*. This arrangement makes it possible to move the sheet away from the lever member 101 before the rear end, i.e., an upstream end in the sheet conveying direction, of the sheet passes through the lever member 101. Still further, the registration roller pair 209 is arranged such that the nip line, i.e., the tangential line of the nip portion N2 of the registration roller pair 209, does not intersect with the lever member 101 in the standby state.

Figure 3A:
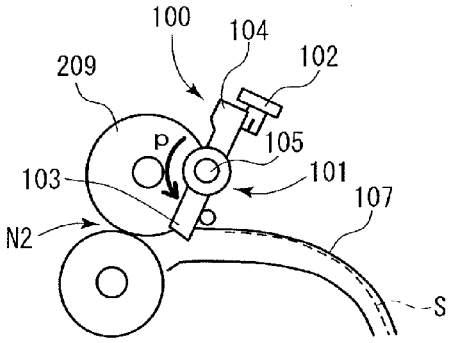
FIG. 3A is a side view illustrating a state in which a sheet is being conveyed toward a registration roller pair.

Next, a sheet detecting operation of the sheet detecting apparatus 100 constructed as described above will be described. FIG. 3A is a diagram illustrating a state before the front end of the sheet S reaches the sheet detecting apparatus 100, i.e., a state before the sheet S comes into abutment with the sheet abutting portion 103 of the lever member 101. At this time, the lever member 101 is positioned at the detection standby position.

Figure 3B:
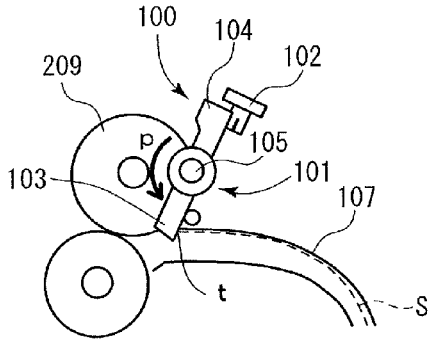
FIG. 3B is a side view illustrating a state in which the sheet abuts against a lever member of the sheet detecting apparatus.
Figure 3C:
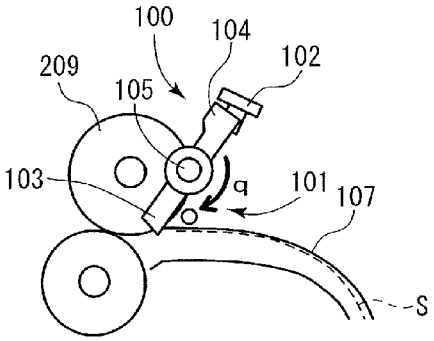
FIG. 3C is a side view illustrating a state in which the lever member turns by being pressed by the sheet.

The sheet S conveyed to the conveying roller pair 208 by the sheet feed roller 206 and conveyed along the conveyance guide 107 by the conveying roller pair 208 finally reaches the front end passing position t as illustrated in FIG. 3B. Subsequently, the sheet S is conveyed while turning the lever member 101 in the direction indicated by the arrow q as illustrated in FIG. 3C. Accordingly, the lever member 101 moves from the detection standby position to the detection position, and the light-shielding flag portion 104 blocks the optical path of the optical sensor 102. Thereby, the control portion 250 detects the passage of the sheet S.

Figure 3D:
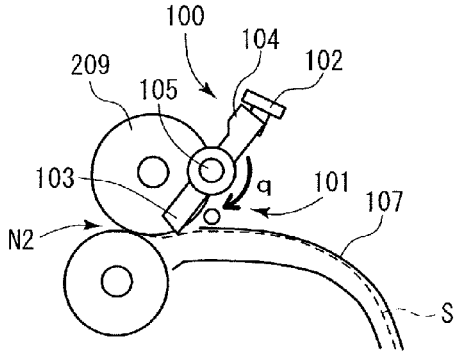
FIG. 3D is a side view illustrating a state in which the sheet enters a nip portion of the registration roller pair.
Figure 3E:
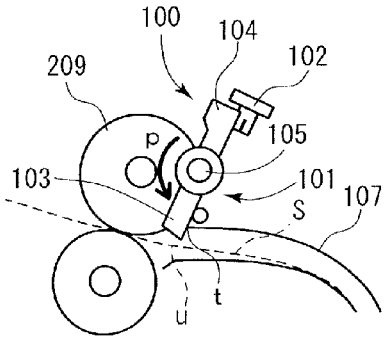
FIG. 3E is a side view illustrating a state in which the sheet is conveyed by the registration roller pair.

Next, the sheet S is conveyed in a state in which the sheet abutting portion 103 is moved to the detection position, and the front end of the sheet S is finally conveyed to the nip portion N2 of the registration roller pair 209 as illustrated in FIG. 3D. After that, the sheet S passes through the nip portion N2 in a state of being nipped by the registration roller pair 209. At this time, a conveyance route of the sheet S is shifted from a route along the conveyance guide 107 up to the front end passing position t to the conveyance passage route u which is positioned on the nip line of the registration roller pair 209 as illustrated in FIG. 3E.

If the conveyance passage route u is shifted, because the sheet conveying direction in passing through the conveyance passage route u is set such that an obtuse angle is formed with respect to the guiding direction of the conveyance guide 107, the sheet S moves in a direction away from the sheet abutting portion 103. Thereby, the lever member 101 turns in the direction indicated by the arrow p by the bias spring and returns back to the detection standby position, and in association with it, the light-shielding flag portion 104 retracts from the optical path of the optical sensor 102, whereby the light-receiving portion receives light from the light-emitting portion again, and the optical sensor 102 turns into a non-detection state.

In this manner, when the front end of the sheet S is conveyed to the nip portion N1 of the registration roller pair 209, the lever member 101 finally returns back to the detection standby position before the rear end of the sheet S passes through. Thereby, the sheet detecting apparatus 100 is put into a state being able to detect the front end of a succeeding sheet S2 before the rear end of the sheet S passes through.

Figure 3F:
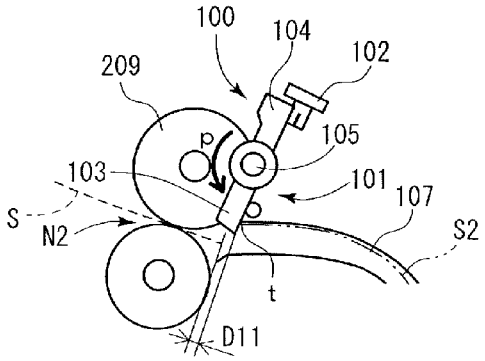
FIG. 3F is a side view illustrating a state in which a rear end of the sheet passes through the sheet detecting apparatus.

By the way, according to the present embodiment, the succeeding sheet is started to be fed while the sheet S is being conveyed, and the sheet fed next is conveyed by the conveying roller pair 208 along the conveyance guide 107. Then, as illustrated in FIG. 3F, the succeeding sheet S2 comes into abutment with the lever member 101 that has moved to the detection standby position at the front end passing position t, and then turns the lever member 101.

At this time, the rear end of the preceding sheet S has not passed through the nip portion N2 of the registration roller pair 209 yet. However, since the lever member 101 has moved to the detection standby position, it is possible to detect the succeeding sheet S2 by the lever member 101 irrespective of the position of the rear end of the preceding sheet S. Consequently, a distance D11 between the rear end of the preceding sheet S and the front end of the sheet S2 can be brought closer to zero limitlessly.

As described above, according to the present embodiment, the lever member 101 is arranged such that the rear end of the sheet does not pass within the moving trajectory when the lever member 101 moves from the detection state to the detection standby position. Still further, the sheet conveying direction of the registration roller pair 209 is set to form an obtuse angle with respect to the guiding direction of the conveyance guide 107 going in a positive direction (counter-clockwise). Accordingly, this arrangement makes it possible to move the sheet away from the lever member 101 before the rear end of the sheet passes through the lever member 101 and to return the lever member 101 back to the detection standby position during a period until when the rear end of the sheet passes through since the passage of the front end thereof.

Then, by arranging the lever member 101 such that it returns to the detection standby position during the period until when the rear end of the sheet passes through since the passage of the front end thereof as described above, it becomes possible to detect the succeeding sheet before the rear end of the sheet passes through the sheet detecting apparatus 100. Thereby, it becomes unnecessary to consider a time otherwise required for the lever member 101 to return to the detection standby position, so that it becomes possible to detect the sheet with a short inter-sheet distance even if a sheet conveying speed is high. As a result, it becomes possible to shorten the inter-sheet distance and to improve an image forming speed.

Still further, because the sheet S is kept in a state of being moved away from the lever member 101 in the course of conveyance, i.e., until when the rear end of the sheet passes through the lever member 101, it is possible to prevent an occurrence of damage, bending and the like of the sheet S otherwise caused by the lever member 101. In addition, when a user pulls out the sheet S in clearing a jam or the like, it is possible to prevent the sheet S from being caught by the lever member 101 and from being damaged.

Next, a second embodiment of the present invention will be described.

Figure 4:
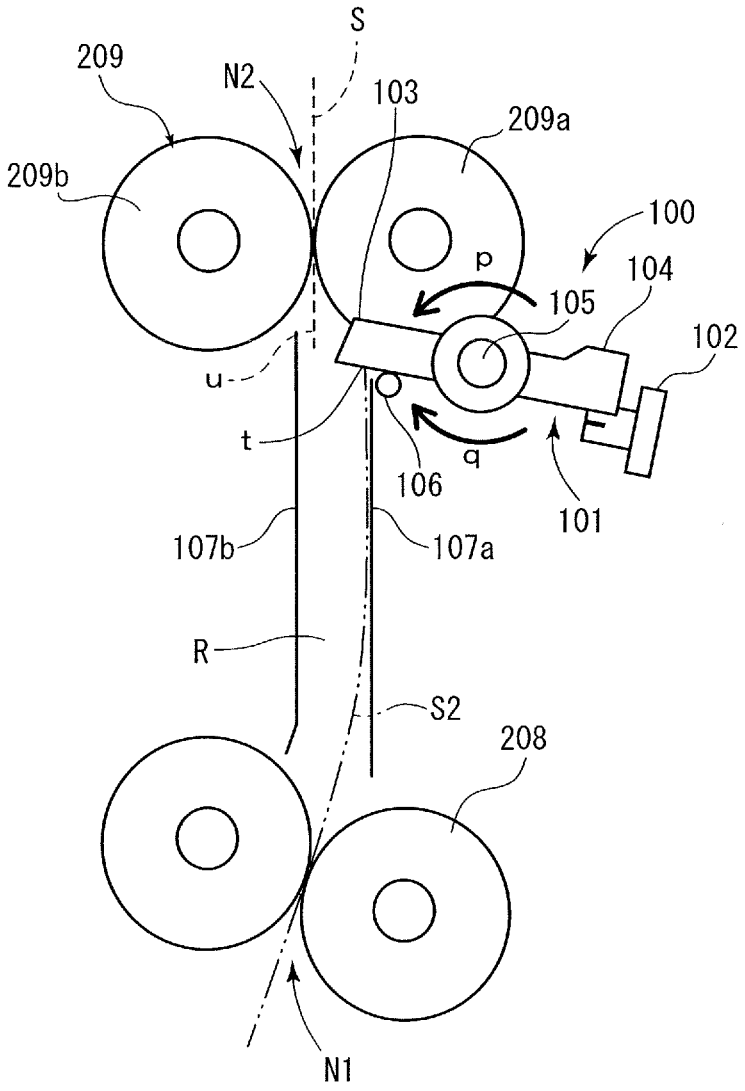
FIG. 4 is a schematic diagram illustrating a sheet conveying apparatus of a second embodiment of the present disclosure.

FIG. 4 is a diagram illustrating a configuration of the sheet conveying apparatus of the present embodiment. In FIG. 4, the same reference signs as those in FIG. 2 described above indicate the same or corresponding portions. In FIG. 4, straight first and second conveyance guides 107*a* and 107*b* are provided between the conveying roller pair 208 and the registration roller pair 209 so as to oppose to each other and compose the sheet conveyance path R.

It is noted that in the present embodiment, the direction of the nip line of the conveying roller pair 208 corresponds to a direction in which the conveyed sheet is brought into abutment with the first conveyance guide 107*a*. More specifically, the conveying roller pair 208 is arranged such that the nip line of the nip portion N1 of the conveying roller pair 208 inclines in a direction approaching from the second rotator 209*b* side to the first rotator 209*a* side as the nip line advances from upstream to downstream in the sheet conveying direction. Still further, the direction of the nip line of the registration roller pair 209 runs in parallel with the conveyance guide 107*a*, differing from the nip line of the conveying roller pair 208. The conveyance passage route u is set on a substantially straight line connecting the nip portion N2 of the registration roller pair 209 and the nip portion N1 of the conveying roller pair 208.

Still further, according to the present embodiment, a sheet conveying speed of the registration roller pair 209 is set to be higher than a sheet conveying speed of the conveying roller pair 208 at least when the sheet is conveyed while being nipped by both of the nip portions N1 and N2 of the conveying roller pair 208 and the registration roller pair 209. That is, the registration roller pair 209 is set such that a rotational speed thereof is higher than a rotational speed of the conveying roller pair 208 at least when the sheet is nipped and conveyed by both of the nip portions N1 and N2 of the conveying roller pair 208 and the registration roller pair 209. With the provision of a difference of the sheet conveying speeds as described above, the sheet S passes through the conveyance passage route u between the registration roller pair 209 and the conveying roller pair 208 in a stretched state after having been nipped by the registration roller pair 209.

Still further, according to the present embodiment, when the lever member 101 is located at the detection standby position, the lever member 101 is arranged so as not to intersect with an imaginary straight line connecting the nip portion N2 of the registration roller pair 209 and the nip portion N1 of the conveying roller pair 208. Thereby, the lever member 101 is moved away from the sheet S when the sheet S passes through the conveyance passage route u in the stretched state.

Figure 5A:
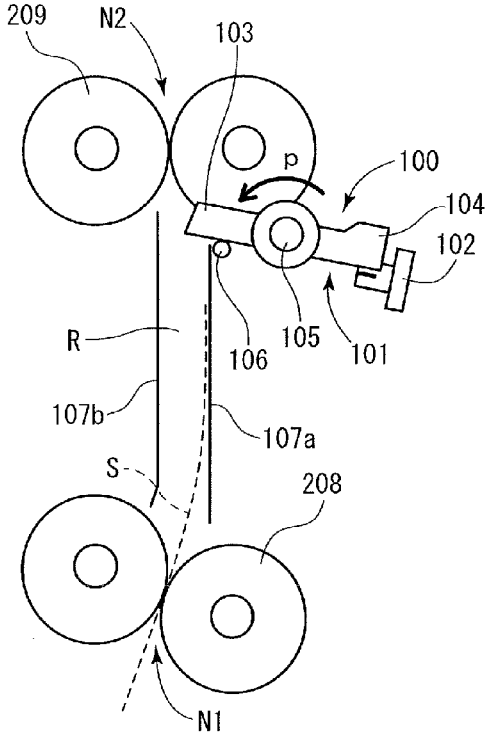
FIG. 5A is a side view illustrating a state in which the sheet is conveyed toward the registration roller pair.

Next, the sheet detecting operation of the sheet detecting apparatus 100 configured as described above will be described. FIG. 5A is a diagram illustrating the state before the front end of the sheet S reaches the sheet detecting apparatus 100, i.e., the state before the sheet S comes into abutment with the sheet abutting portion 103 of the lever member 101. At this time, the lever member 101 is positioned at the detection standby position.

Figure 5B:
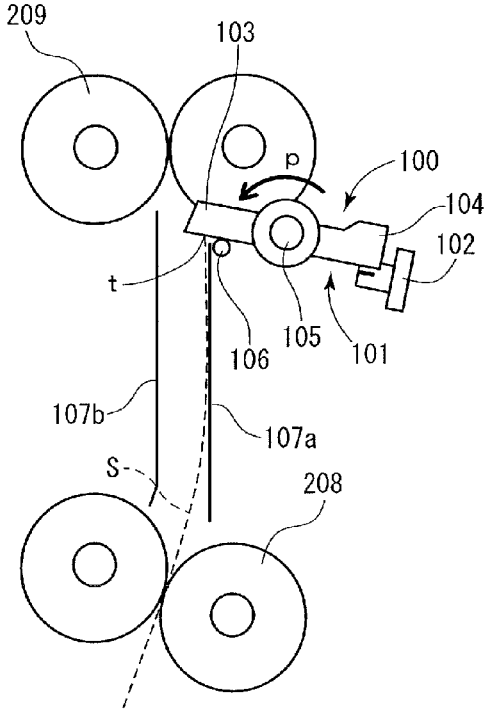
FIG. 5B is a side view illustrating a state in which the sheet abuts against the lever member of the sheet detecting apparatus.
Figure 5C:
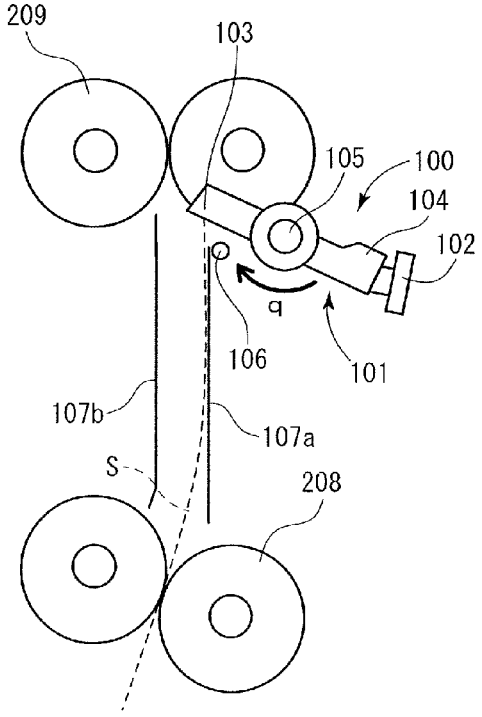
FIG. 5C is a side view illustrating a state in which the lever member turns by being pressed by the sheet.

The sheet S conveyed to the conveying roller pair 208 by the sheet feed roller 206 and conveyed along the conveyance guide 107 in the direction of the nip line of the conveying roller pair 208 finally reaches the front end passing position t as illustrated in FIG. 5B. Subsequently, the sheet S is conveyed while turning the lever member 101 retained at the detection standby position in abutment with the stopper 106 in the direction indicated by the arrow q as illustrated in FIG. 5C. Thereby, the lever member 101 moves from the detection standby position to the detection position, and the light-shielding flag portion 104 blocks the optical path of the optical sensor 102. Accordingly, the control portion 250 detects the passage of the sheet S.

Figure 5D:
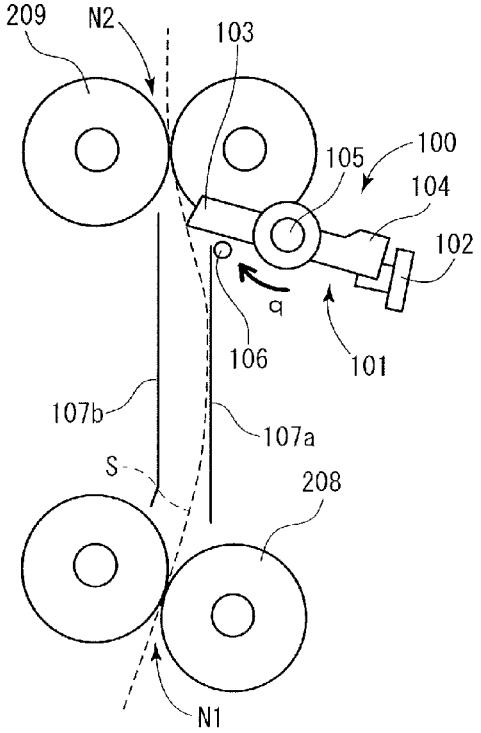
FIG. 5D is a side view illustrating a state in which the sheet enters the nip portion of the registration roller pair.

Next, the sheet S is conveyed in the state in which the sheet abutting portion 103 is moved to the detection position, and the front end of the sheet S is finally conveyed to the nip portion N2 of the registration roller pair 209 as illustrated in FIG. 5D. Subsequently, the sheet S passes through the nip portion N2 in a state of being nipped by the registration roller pair 209.

Figure 6A:
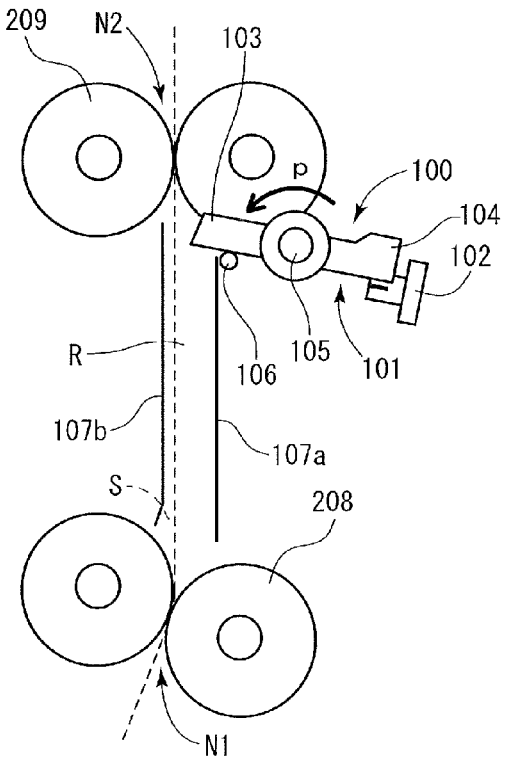
FIG. 6A is a side view illustrating a state in which the sheet is conveyed by the registration roller pair.

At this time, as described above, the sheet conveying speed of the registration roller pair 209 is set to be higher than the sheet conveying speed of the conveying roller pair 208. Therefore, the sheet S is conveyed on a substantially straight line connecting both of the nip portions N1 and N2 between the conveying roller pair 208 and the registration roller pair 209 while maintaining the stretched state. Thereby, the conveyance route of the sheet S is shifted from the route along the conveyance guide 107 until reaching to the front end passing position t to the conveyance passage route u which is positioned on the nip line of the registration roller pair 209 as illustrated in FIG. 6A.

Then, if the conveyance passing route is shifted, the sheet S moves in a direction away from the sheet abutting portion 103. Thereby, the lever member 101 is turned in the direction indicated by the arrow p by the bias spring and returns back to the detection standby position, and in association with it, the light-shielding flag portion 104 retracts from the optical path of the optical sensor 102, whereby the light-receiving portion receives light from the light-emitting portion again, and the optical sensor 102 is put into the non-detection state.

In this manner, when the front end of the sheet S is conveyed to the nip portion N1 of the registration roller pair 209, the lever member 101 returns back to the detection standby position by the difference between the conveying speeds of the registration roller pair 209 and the conveying roller pair 208 and a bias force exerted by the bias spring. In other words, in the present embodiment, if the sheet S passes through the front end passing position t, the lever member 101 returns back to the detection standby position before the rear end of the sheet S passes through. Accordingly, the sheet detecting apparatus 100 is put into a state being able to detect the front end of the succeeding sheet S2 before the rear end of the sheet S passes through.

Figure 6B:
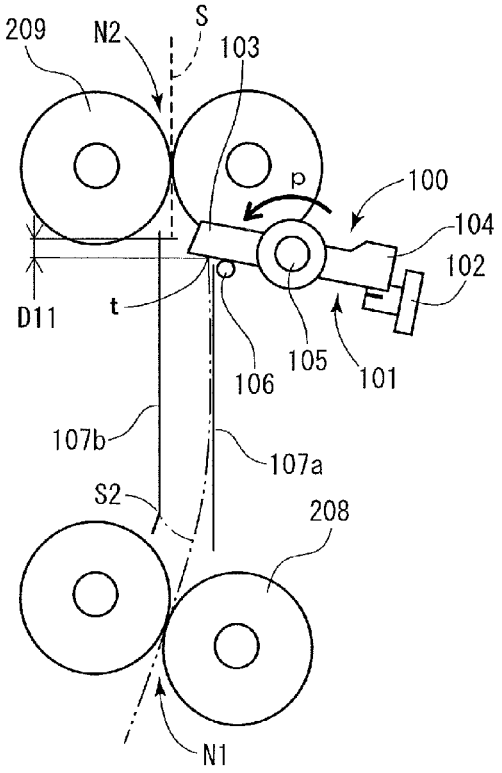
FIG. 6B is a side view illustrating a state in which the rear end of the sheet passes through the sheet detecting apparatus.

The sheet fed next is conveyed along the conveyance guide 107 by the conveying roller pair 208, and finally comes into abutment with the lever member 101 moved to the detection standby position as illustrated in FIG. 6B, and then turns the lever member 101. At this time, the rear end of the preceding sheet S has not passed through the nip portion N2 of the registration roller pair 209 yet. However, since the lever member 101 has moved to the detection standby position, it is possible to detect the succeeding sheet S2 by the lever member 101 irrespective of the position of the rear end of the preceding sheet S. Consequently, the distance D11 between the rear end of the preceding sheet S and the front end of the sheet S2 can be brought closer to zero limitlessly.

As described above, according to the present embodiment, the sheet conveying speed of the registration roller pair 209 is set to be higher than the sheet conveying speed of the conveying roller pair 208. When the lever member 101 is located at the detection standby position, the lever member 101 is arranged so as not to intersect with the imaginary straight line connecting the nip portion N2 of the registration roller pair 209 and the nip portion N1 of the conveying roller pair 208.

Thereby, when the sheet S is nipped by the registration roller pair 209 and then passes through the conveyance passage route u in the stretched state, the lever member 101 moves away from the sheet S and returns to the detection standby position. Then, by arranging such that the lever member 101 returns to the detection standby position during a period before when the rear end of the sheet passes through after the passage of the front end of the sheet as described above, it becomes possible to detect the succeeding sheet before the rear end of the sheet passes through the sheet detecting apparatus 100. Accordingly, it is possible to bring about the same effects and advantages as those in the first embodiment described above by the present embodiment.

Figure 7:
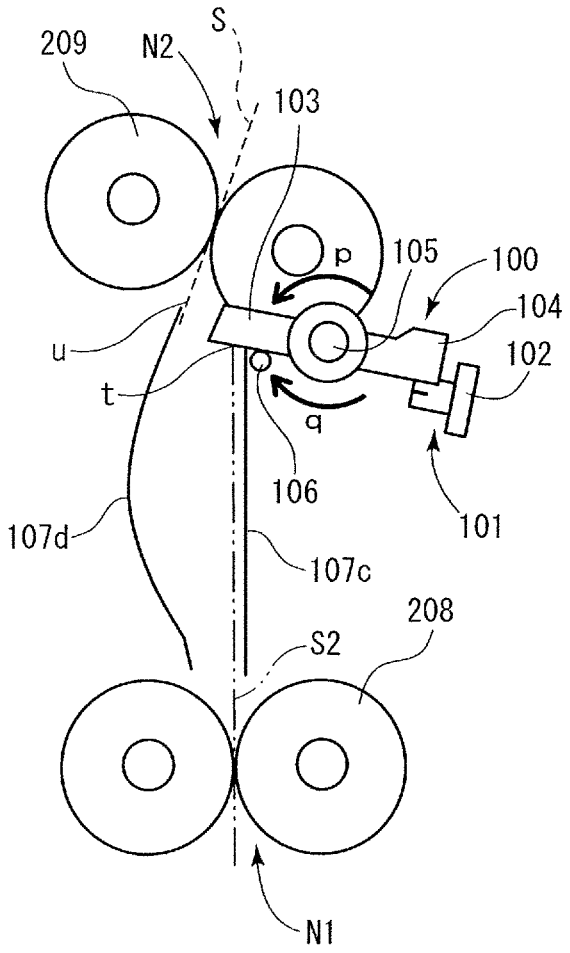
FIG. 7 is a schematic diagram illustrating a sheet conveying apparatus of a third embodiment of the present disclosure.

Next, a third embodiment of the present invention will be described. FIG. 7 is a diagram illustrating a configuration of the sheet conveying apparatus of the present embodiment. In FIG. 7, the same reference signs as those in FIG. 5 described above denote the same or corresponding portions.

In FIG. 7, first and second conveyance guides 107*c* and 107*d* are provided between the conveying roller pair 208 and the registration roller pair 209 so as to oppose to each other and compose the sheet conveyance path R. The first conveyance guide 107*c* has a straight shape, and the second conveyance guide 107*d*, which is an opposed guide portion provided so as to oppose the first conveyance guide 107*c*, has a curved shape bulging outward. That is, the second conveyance guide 107*d* is formed curvedly in a direction away from the first conveyance guide 107*c*.

It is noted that in the present embodiment, the nip line of the conveying roller pair 208 runs in a direction in parallel with the first conveyance guide 107*c*. Unlike the direction of the nip line of the conveying roller pair 208, a direction of the nip line of the registration roller pair 209 runs in parallel with a downstream part in the sheet conveying direction of the conveyance guide 107*d*. That is, the conveying roller pair 208 is arranged such that the nip line, i.e., the tangential line of the nip portion N1, of the conveying roller pair 208 intersects with the optical sensor 102 of the lever member 101 in the standby state.

Still further, according to the present embodiment, the sheet conveying speed of the registration roller pair 209 is set to be lower than the sheet conveying speed of the conveying roller pair 208. In this manner, with the provision of a difference of the sheet conveying speeds, the sheet S passes through the conveyance passage route u between the registration roller pair 209 and the conveying roller pair 208 while deflecting toward the second conveyance guide 107*d* after having nipped by the registration roller pair 209. That is, the registration roller pair 209 is set such that a rotational speed thereof is lower than a rotational speed of the conveying roller pair 208 at least when the sheet is nipped and conveyed by both of nip portions N1 and N2 of the conveying roller pair 208 and the registration roller pair 209. Accordingly, when the sheet S passes through the conveyance passage route u, the lever member 101 is moved away from the sheet S.

Figure 8A:
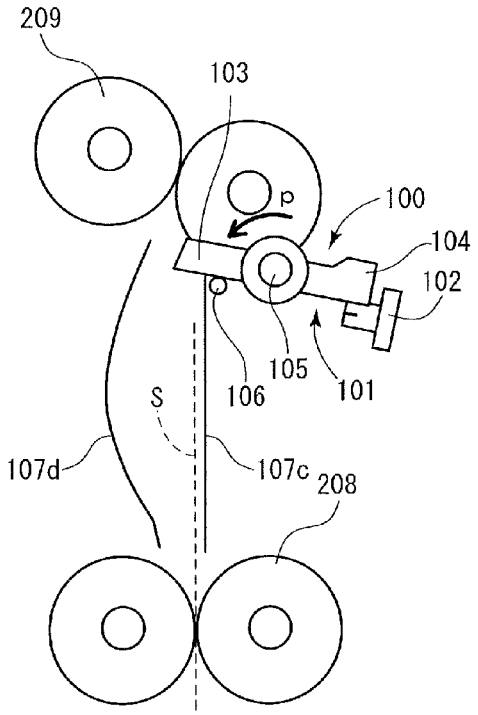
FIG. 8A is a side view illustrating a state in which the sheet is conveyed toward the registration roller pair.

Next, the sheet detecting operation of the sheet detecting apparatus 100 configured as described above will be described. FIG. 8A is a diagram illustrating the state before the front end of the sheet S reaches the sheet detecting apparatus 100, i.e., the state before the sheet S comes into abutment with the sheet abutting portion 103 of the lever member 101. At this time, the lever member 101 is positioned at the detection standby position.

Figure 8B:
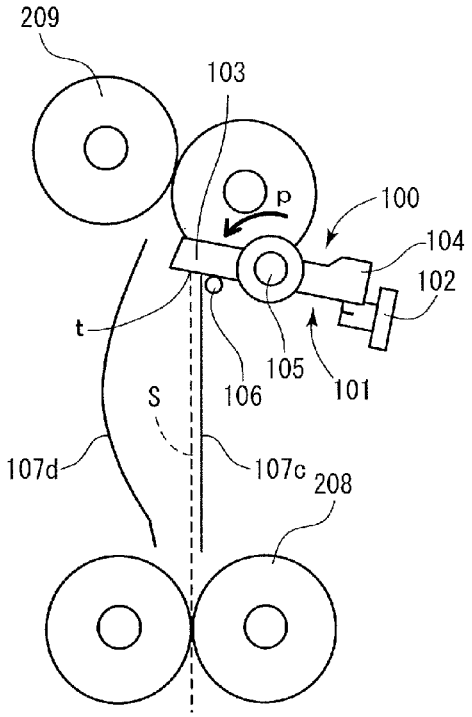
FIG. 8B is a side view illustrating a state in which the sheet abuts against the lever member of the sheet detecting apparatus.
Figure 8C:
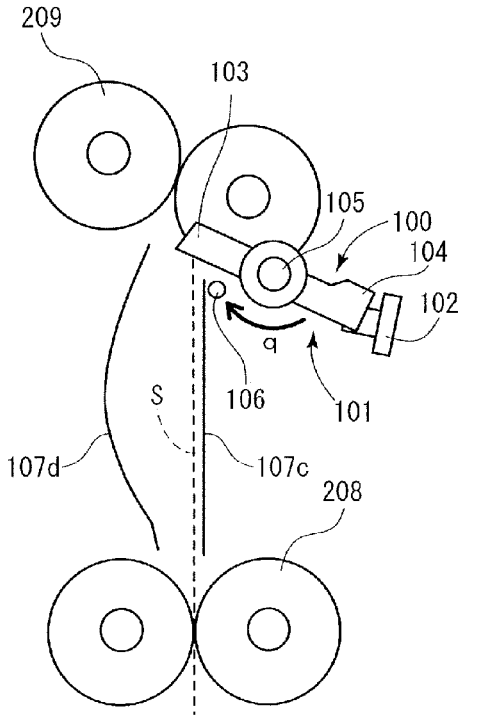
FIG. 8C is a side view illustrating a state in which the lever member turns by being pressed by the sheet.

The sheet S conveyed to the conveying roller pair 208 by the sheet feed roller 206 and conveyed along the first conveyance guide 107*c* by the conveying roller pair 208 finally reaches the front end passing position t as illustrated in FIG. 8B. Subsequently, the sheet S is conveyed while turning the lever member 101 in the direction indicated by the arrow q as illustrated in FIG. 8C. Accordingly, the lever member 101 moves from the detection standby position to the detection position, and the light-shielding flag portion 104 blocks the optical path of the optical sensor 102. Accordingly, the control portion 250 detects the passage of the sheet S.

Figure 8D:
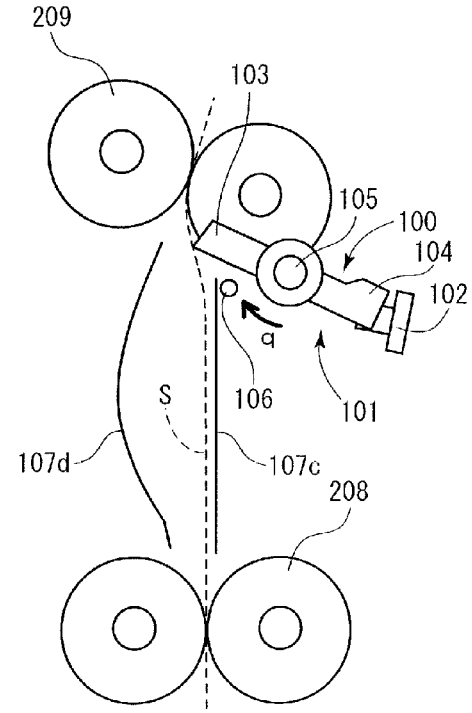
FIG. 8D is a side view illustrating a state in which the sheet enters the nip portion of the registration roller pair.

Next, the sheet S is conveyed in a state in which the sheet abutting portion 103 is moved to the detection position, and the front end thereof is conveyed to the nip portion N2 of the registration roller pair 209 as illustrated in FIG. 8D. Subsequently, the sheet S passes through the nip portion N2 in the state of being nipped by the registration roller pair 209.

Figure 9A:
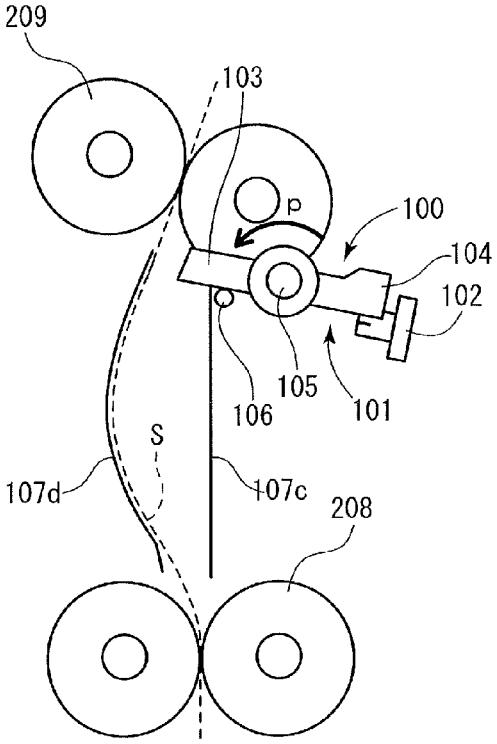
FIG. 9A is a side view illustrating a state in which the sheet is conveyed by the registration roller pair.

At this time, the conveying speed of the registration roller pair 209 is set to be lower than the conveying speed of the conveying roller pair 208. Therefore, the sheet S is conveyed while being deflected toward the second conveyance guide 107*d* between the conveying roller pair 208 and the registration roller pair 209 as illustrated in FIG. 9A. Accordingly, the conveyance route of the sheet S is shifted from a route along the first conveyance guide 107*c* until reaching to the front end passing position t to the conveyance passage route u which is positioned on the nip line of the registration roller pair 209.

Then, when the conveyance passage route is shifted, the sheet S moves in the direction away from the sheet abutting portion 103. In association with this movement, the lever member 101 turns in the direction indicated by the arrow p by the bias spring, and starts to return back to the detection standby position, and in association with it, the light-shielding flag portion 104 retracts from the optical path, whereby the light-receiving portion receives light from the light-emitting portion again and the optical sensor 102 is put into the non-detection state.

In this manner, when the front end of the sheet S is conveyed to the nip portion N1 of the registration roller pair 209, the lever member 101 returns back to the detection standby position by the difference between the conveying speeds of the registration roller pair 209 and the conveying roller pair 208 and the bias force exerted by the bias spring. In other words, according to the present embodiment, when the sheet S passes through the front end passing position t, the lever member 101 returns back to the detection standby position before the rear end of the sheet S passes through. Accordingly, the sheet detecting apparatus 100 is put into a state being able to detect the front end of the succeeding sheet S2 before the rear end of the sheet S passes through.

Figure 9B:
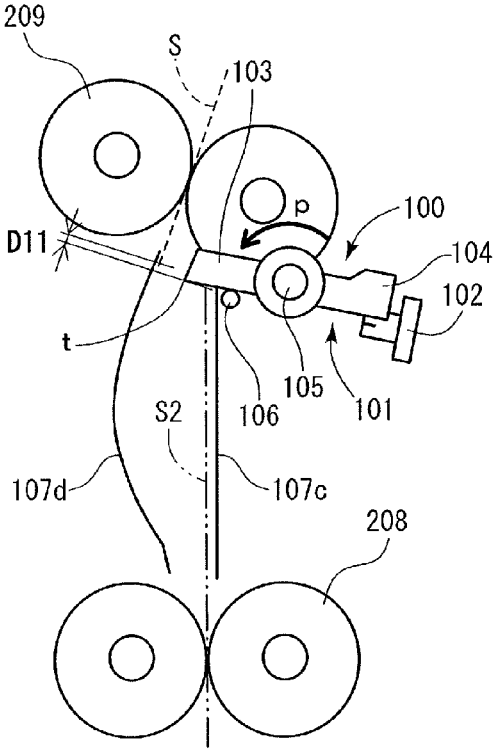
FIG. 9B is a side view illustrating a state in which the rear end of the sheet passes through the sheet detecting apparatus.

The sheet fed next is conveyed along the first conveyance guide 107*c* by the conveying roller pair 208, and finally comes into abutment with the lever member 101 moved to the detection standby position as illustrated in FIG. 9B, and then turns the lever member 101. At this time, the rear end of the preceding sheet S has not passed through the nip portion N2 of the registration roller pair 209 yet. However, since the lever member 101 has moved to the detection standby position, it is possible to detect the succeeding sheet S2 by the lever member 101 irrespective of the position of the rear end of the preceding sheet S. Consequently, the distance D11 between the rear end of the preceding sheet S and the front end of the sheet S2 can be brought closer to zero limitlessly.

As described above, according to the present embodiment, the sheet conveying speed of the registration roller pair 209 is set to be lower than the sheet conveying speed of the conveying roller pair 208. The lever member 101 moves away from the sheet S and returns back to the detection standby position when the sheet S passes through the conveyance passage route u while being deflected toward the second conveyance guide 107*d* after being nipped by the registration roller pair 209 by providing the difference of the sheet conveying speeds as described above. Accordingly, it is possible to bring about the same effects and advantages as those in the first embodiment described above.

Figure 10:
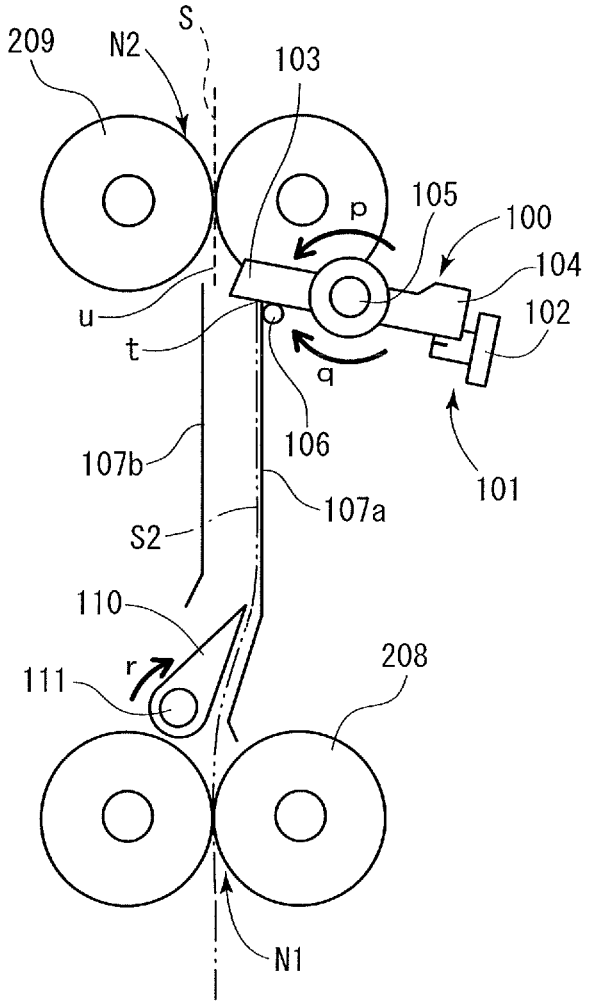
FIG. 10 is a schematic diagram illustrating a sheet conveying apparatus of a second embodiment of the present disclosure.

Next, a fourth embodiment of the present invention will be described. FIG. 10 is a diagram illustrating a configuration of the sheet conveying apparatus of the present embodiment. In FIG. 10, the same reference signs as those in FIG. 4 described above denote the same or corresponding portions.

In FIG. 10, a guide member 110, i.e., a sheet conveying direction regulating member, provided so as to be turnable about a shaft 111 at downstream in the sheet conveying direction of the conveying roller pair 208, and directs the sheet conveyed by the conveying roller pair 208 toward the first conveyance guide 107*a*. The guide member 110 is biased toward a direction indicated by an arrow r to bring the sheet being conveyed into abutment with the first conveyance guide 107*a* by the bias spring. Still further, according to the present embodiment, the sheet conveying speed of the registration roller pair 209 is set to be higher than the sheet conveying speed of the conveying roller pair 208. In this manner, with the provision of the difference of the sheet conveying speeds, the sheet S passes through the conveyance passage route u between the registration roller pair 209 and the conveying roller pair 208 in the stretched state after having nipped by the registration roller pair 209. That is, guide member 110 is the sheet conveying direction regulating member being capable of moving the sheet conveyed by the conveying roller pair 208 to a first position from which the sheet is directed to a side of the first conveyance guide 107*a* and to a second position moved to a side of the second conveyance guide 107*d* from the first position.

Here, the sheet S which has passed through the conveying roller pair 208 is guided in the direction to come into abutment with the first conveyance guide 107*a* by the guide member 110 until when the sheet S is nipped by the registration roller pair 209. The sheet S after having abutted with the first conveyance guide 107*a* moves along the first conveyance guide 107*a*, and finally comes into abutment with the sheet abutting portion 103. When the conveyance of the sheet S advances and the sheet S is conveyed between the registration roller pair 209 and the conveying roller pair 208 in the stretched state, the guide member 110 is pressed by the sheet S in the stretched state, and turns in a direction opposite from the arrow r against the bias spring.

Figure 11A:
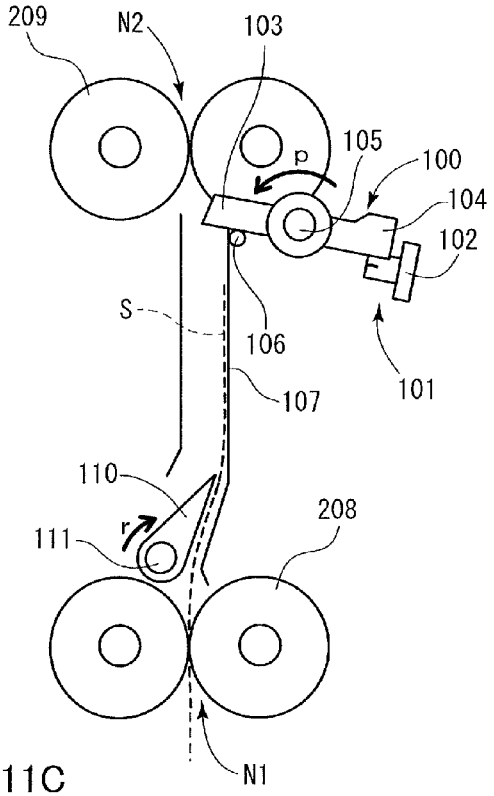
FIG. 11A is a side view illustrating a state in which the sheet is conveyed toward the registration roller pair.

Next, the sheet detecting operation of the sheet detecting apparatus 100 configured as described above will be described. FIG. 11A is a diagram illustrating the state before the front end of the sheet S reaches the sheet detecting apparatus 100, i.e., a state before the sheet comes into abutment with the sheet abutting portion 103 of the lever member 101.

At this time, the lever member 101 is positioned at the detection standby position, and the guide member 110 is moved to a side of the first conveyance guide 107*a*.

Figure 11B:
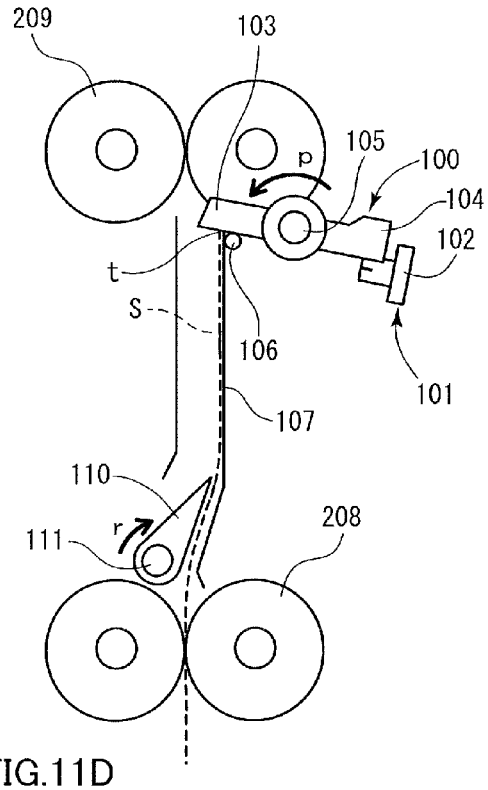
FIG. 11B is a side view illustrating a state in which the sheet abuts against the lever member of the sheet detecting apparatus.
Figure 11C:
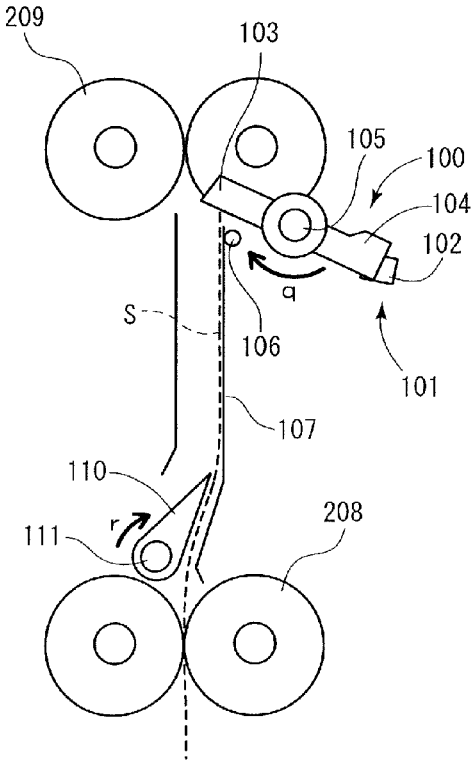
FIG. 11C is a side view illustrating a state in which the lever member turns by being pressed by the sheet.

The sheet S conveyed to the conveying roller pair 208 by the sheet feed roller 206 and guided along the first conveyance guide 107*a* by the guide member 110 finally reaches the front end passing position t as illustrated in FIG. 11B. Subsequently, the sheet S is conveyed while turning the lever member 101 in the direction indicated by the arrow q as illustrated in FIG. 11C. Accordingly, the lever member 101 moves from the detection standby position to the detection position, and the light-shielding flag portion 104 blocks the optical path of the optical sensor 102. Accordingly, the control portion 250 detects the passage of the sheet S.

Figure 11D:
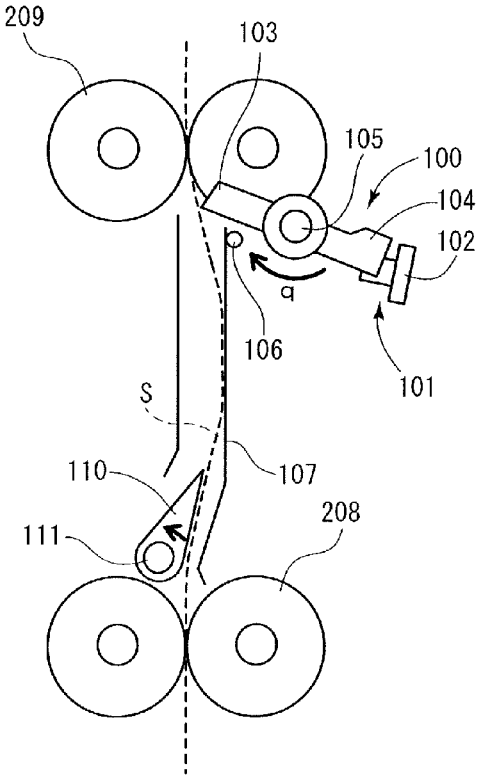
FIG. 11D is a side view illustrating a state in which the sheet enters the nip portion of the registration roller pair.

Next, the sheet S is conveyed while moving the sheet abutting portion 103 to the detection position, and the front end of the sheet S is finally conveyed to the nip portion N2 of the registration roller pair 209 as illustrated in FIG. 11D. Subsequently, the sheet S passes through the nip portion N2 while being nipped by the registration roller pair 209.

Figure 12A:
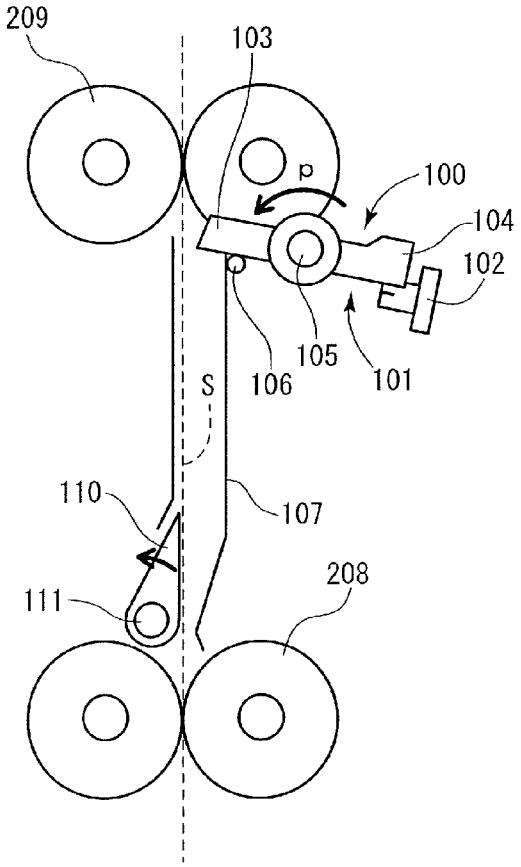
FIG. 12A is a side view illustrating a state in which the sheet is conveyed by the registration roller pair.

The sheet conveying speed of the registration roller pair 209 at this time is set to be higher than the conveying speed of the conveying roller pair 208 as described above. Therefore, the sheet S is conveyed on the substantially straight line connecting both of the nip portions N1 and N2 between the conveying roller pair 208 and the registration roller pair 209 while maintaining the stretched state. Accordingly, the guide member 110 is pressed by the sheet S in the stretched state, and is turned in the direction opposite from the arrow r against the bias spring as illustrated in FIG. 12A. Also, the conveyance route of the sheet S is shifted from a route along the conveyance guide 107 until reaching to the front end passing position t to the conveyance passage route u which is positioned on the nip line of the registration roller pair 209.

When the conveyance passage route is moved, the sheet S moves in the direction away from the sheet abutting portion 103. Accordingly, the lever member 101 turns in the direction indicated by the arrow p by the bias spring and returns back to the detection standby position, and in association with it, the light-shielding flag portion 104 retracts from the optical path of the optical sensor 102, whereby the light-receiving portion receives light from the light-emitting portion again, and the optical sensor 102 turns into a non-detection state.

In this manner, when the front end of the sheet S is conveyed to the nip portion N1 of the registration roller pair 209, the lever member 101 returns back to the detection standby position by the difference between the conveying speeds of the registration roller pair 209 and the conveying roller pair 208 and the bias force exerted by the bias spring. In other words, according to the present embodiment, when the sheet S passes through the front end passing position t, the lever member 101 returns to the detection standby position before the rear end of the sheet S passes through. Accordingly, the sheet detecting apparatus 100 is put into the state being able to detect the front end of the succeeding sheet S2 before the rear end of the sheet S passes through.

Figure 12B:
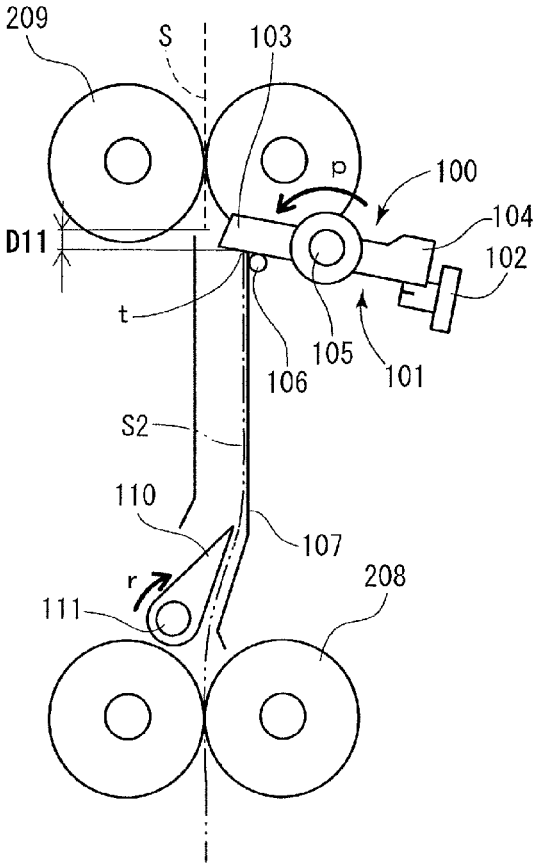
FIG. 12B is a side view illustrating a state in which the rear end of the sheet passes through the sheet detecting apparatus.

The sheet fed next is conveyed along the conveyance guide 107 by the conveying roller pair 208, and finally comes into abutment with the lever member 101 moved to the detection standby position as illustrated in FIG. 12B, and then turns the lever member 101. At this time, the rear end of the preceding sheet S has not passed through the nip portion N2 of the registration roller pair 209 yet. However, since the lever member 101 has moved to the detection standby position, it is possible to detect the succeeding sheet S2 by the lever member 101 irrespective of the position of the rear end of the preceding sheet S. Consequently, the distance D11 between the rear end of the preceding sheet S and the front end of the sheet S2 can be brought closer to zero limitlessly.

As described above, in the present embodiment as well, the lever member 101 is configured to return back to the detection standby position after the passage of the front end of the sheet before the rear end passes through. Accordingly, the same effects and advantages as in the first embodiment described already are achieved.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076748, filed on Apr. 3, 2014, which is hereby incorporated by reference herein in its entirety.

What is claimed is:

1. A sheet conveying apparatus comprising:

a first rotator pair conveying a sheet;

a second rotator pair provided downstream, in a sheet conveying direction, of the first rotator pair; and a sheet detecting portion detecting the sheet being conveyed in a sheet conveying path between the first and second rotator pairs, the sheet detecting portion including:

a moving member configured to turn to a standby state in which at least part of the moving member protrudes into the sheet conveying path and turn to a detection state in which the entire moving member retracts from the sheet conveying path;

a stopper against which the moving member abuts, the moving member being held in the standby state by abutting against the stopper; and a sensor configured to detect the turn of the moving member from the standby state to the detection state, wherein the moving member turns from the standby state to the detection state by being pushed by a front end of the sheet conveyed by the first rotator pair, wherein the stopper is disposed to be closer to a nip portion of the second rotator pair than the sensor, wherein the moving member returns from the detection state to the standby state in which the moving member is held by the stopper before a rear end of the sheet reaches to the nip portion of the second rotator pair, and wherein the second rotator pair is arranged such that a nip line of the second rotator pair, which is a tangential line of the nip portion of the second rotator pair, does not intersect with the moving member in the standby state when viewed from a direction of a rotation axis of the second rotator pair.

2. The sheet conveying apparatus according to claim 1, further comprising a guide portion provided upstream, in the sheet conveying direction, of the second rotator pair and guiding the sheet, wherein the second rotator pair includes an upper rotator disposed on a side of the sheet detecting portion with respect to the sheet conveying path and a lower rotator disposed opposite to the upper rotator, and wherein the guide portion guides the sheet such that the front end of the sheet, which has abutted against the moving member and does not reach to the nip portion of the second rotator pair, contacts with the upper rotator.

3. The sheet conveying apparatus according to claim 1, wherein the second rotator pair includes a first rotator provided on the same side with the moving member with respect to the nip portion of the second rotator pair, and a second rotator disposed opposite to the first rotator, and wherein the nip line, which is the tangential line of the nip portion of the second rotator pair, is inclined in a direction approaching to a side of the first rotator from a side of the second rotator as the nip line advances upstream to downstream in the sheet conveying direction when viewed from a direction of a rotation axis of the second rotator pair.

4. The sheet conveying apparatus according to claim 3, further comprising a guide portion composing the sheet conveying path, wherein a sheet conveying direction of the second rotator pair is set to form an obtuse angle with respect to a sheet guide direction of the guide portion going in a positive direction.

5. The sheet conveying apparatus according to claim 1, wherein the sheet conveying path between the first rotator pair and the second rotator pair includes a guide portion constructed such that a curvature of a first rotator side is larger than a curvature of a second rotator side.

6. The sheet conveying apparatus according to claim 1, wherein the second rotator pair includes a first rotator provided on the same side with the moving member with respect to the nip portion of the second rotator pair, and a second rotator disposed opposite to the first rotator, and wherein the first rotator pair is arranged such that a nip line, which is a tangential line of the nip portion of the first rotator pair, is inclined in a direction approaching to a first rotator side from a second rotator side as the nip line of the first rotator pair advances upstream to downstream in the sheet conveying direction.

7. The sheet conveying apparatus according to claim 1, wherein the first and second rotator pairs are arranged such that an imaginary straight line connecting nip portions of the first and second rotator pairs does not intersect with the moving member in the standby state, and wherein the second rotator pair is set such that a rotational speed thereof is higher than a rotational speed of the first rotator pair at least when the sheet is nipped and conveyed by both of the nip portions of the first and second rotator pairs.

8. The sheet conveying apparatus according to claim 1, wherein the second rotator pair is set such that a rotational speed thereof is lower than a rotational speed of the first rotator pair at least when the sheet is nipped and conveyed by both of nip portions of the first and second rotator pairs.

9. The sheet conveying apparatus according to claim 7, wherein the second rotator pair includes a first rotator provided on the same side with the moving member with respect to the nip portion of the second rotator pair and a second rotator disposed opposite to the first rotator, and wherein the nip line, which is the tangential line of the nip portion of the second rotator pair, is inclined in a direction approaching to a first rotator side from a second rotator side as the nip line of the second rotator pair advances upstream to downstream in the sheet conveying direction when viewed from a direction of a rotation axis of the second rotator pair.

10. The sheet conveying apparatus according to claim 1, wherein the first rotator pair is arranged such that a nip line, which is a tangential line of a nip portion of the first rotator pair, intersects with the moving member in the standby state.

11. The sheet conveying apparatus according to claim 8, further comprising a guide portion forming the sheet conveying path between the first and second rotator pairs and including a first conveyance guide guiding the sheet on a side of the moving member of the sheet conveying path and a second conveyance guide provided to face the first conveyance guide, wherein the second conveyance guide is curvedly formed in a direction away from the first conveyance guide.

12. The sheet conveying apparatus according to claim 1, further comprising:

a guide portion forming the sheet conveying path between the first and second rotator pairs and including a first conveyance guide guiding the sheet on a side of the moving member of the sheet conveying path and a second conveyance guide provided to face the first conveyance guide; and a sheet conveying direction regulating member provided downstream, in the sheet conveying direction, of the first rotator pair and capable of moving between a first position where the sheet conveyed by the first rotator pair is directed to a first conveyance guide side and to a second position where the sheet conveying direction regulating member is moved to a second conveyance guide side from the first position.

13. The sheet conveying apparatus according to claim 1, wherein the moving member includes a sensor flag configured to be able to turn between a standby position where the sensor flag protrudes into the sheet conveying path at upstream in the sheet conveying direction of the nip portion of the second rotator pair and a detection position where the sensor flag turns by being pressed by the sheet conveyed by the first rotator pair, wherein the moving member shifts from the standby state to the detection state by the move of the sensor flag from the standby position to the detection position.

14. The sheet conveying apparatus according to claim 1, further comprising a guide portion composing a sheet conveying path between the first and second rotator pairs and including a first conveyance guide guiding the sheet on a moving member side of the sheet conveying path and a second conveyance guide provided to face the first conveyance guide, wherein the moving member is arranged such that a predetermined gap exists between the moving member and the second conveyance guide at the standby position.

15. An image forming apparatus comprising:

an image forming portion; and the sheet conveying apparatus according to claim 1 configured to convey a sheet.

* * * * *